US005219299A

United States Patent [19]

Wang

[11] Patent Number: 5,219,299

[45] Date of Patent: Jun. 15, 1993

[54] RESISTOR COUPLED T-TYPE BNC CONNECTOR

[76] Inventor: Tsan-Chi Wang, 1 Fl., No. 13, Lane 312, Chung Chen Rd., Hsin Tien City, Taipei Hsien, Taiwan

[21] Appl. No.: 943,011

[22] Filed: Sep. 10, 1992

[51] Int. Cl.[5] ..... H01R 29/00

[52] U.S. Cl. ..... 439/188; 439/582

[58] Field of Search ..... 200/51.09-51.11; 439/188, 507, 510-513, 579, 582, 620-622

[56] References Cited

U.S. PATENT DOCUMENTS

| | | | |
|---|---|---|---|
| 2,805,399 | 9/1957 | Leeper | 439/582 |
| 4,746,307 | 5/1988 | Joly et al. | 439/582 |
| 4,797,121 | 1/1989 | Hayward | 439/579 |
| 5,030,122 | 7/1991 | Birch et al. | 439/188 |
| 5,073,123 | 12/1991 | Birch et al. | 439/188 |
| 5,108,300 | 4/1992 | Weber | 439/620 |

*Primary Examiner*—Paula A. Bradley

*Attorney, Agent, or Firm*—Varndell Legal Group

[57] ABSTRACT

A resistor coupled T-type BNC connector includes a ceramic resistor having a top end connected to two contact legs of a spring plate through a flat conductor, which spring plate being retained inside two transverse coupling portions by two end-matched sockets and connected to an electric terminal in a vertical coupling portion, and a bottom end connected to the outer shell of the T-type BNC connector. Fastening a BNC connector to either transverse coupling portion of the T-type BNC connector causes one contact leg of the spring plate lifted from the flat conductor for permitting the ceramic resistor to eliminate outside noises transmitted through the other transverse coupling portion.

3 Claims, 4 Drawing Sheets

RESISTOR COUPLED T-TYPE BNC CONNECTOR

BACKGROUND OF THE INVENTION

The present invention relates to a BNC (bayonet navy connector) connector and relates more particularly to a T-type BNC connector which is coupled with a ceramic resistor to eliminate outside noises effectively.

Various T-type BNC connectors are known and widely used in computer network systems for connecting coaxial cables from one equipment to another. A T-type BNC connector is generally comprised of a vertical coupling end to which a BNC connector of the cable from the mainframe of a computer network system may be connected, and two reversed transverse coupling ends to which a BNC connector on a subsidiary cable from a respective peripheral equipment may be respectively coupled. If either two coupling ends of a BNC connector are respectively coupled with a respective BNC connector for signal transmission while the other coupling end does no work, outside noises may be transmitted through the coupling end which does no work, to interfere with the transmission. According to conventional methods, a cap which is coupled with a resistor (normally of 50j) on the inside may be used and covered over the coupling end not in work, so as to eliminate the interference of outside noises. However, a resistor coupled cap may be lost or disconnected from place easily. There is also disclosed a T-type BNC connector which has a 50j resistor directly installed on the inside to eliminate outside noises. Because a regular 50j resistor has a size, the shell of a T-type BNC connector should be relatively increased so that a regular 50j resistor can be installed on the inside. However, increasing the size of a T-type BNC connector simultaneously increases the manufacturing cost.

SUMMARY OF THE INVENTION

The main object of the present invention is to provide a resistor coupled T-type BNC connector which utilizes a ceramic resistor to eliminate the interference of outside noises so that the size and the manufacturing cost of the connector can be greatly reduced.

According to the preferred embodiment of the present invention, a resistor coupled T-type BNC connector is generally comprised of a ceramic resistor having a top end connected to two contact legs of a spring plate through a flat conductor, which spring plate is retained inside two transverse coupling portions by two end-matched sockets and connected to an electric terminal in a vertical coupling portion, and a bottom end connected to the outer shell of the T-type BNC connector. Fastening a BNC connector to either transverse coupling portion of the T-type BNC connector causes one contact leg of the spring plate disconnected from the flat conductor for permitting the ceramic resistor to eliminate outside noises transmitted through the other transverse coupling portion.

DETAILED DESCRIPTION OF THE PREFERRED EMBODIMENT

Figure 1:
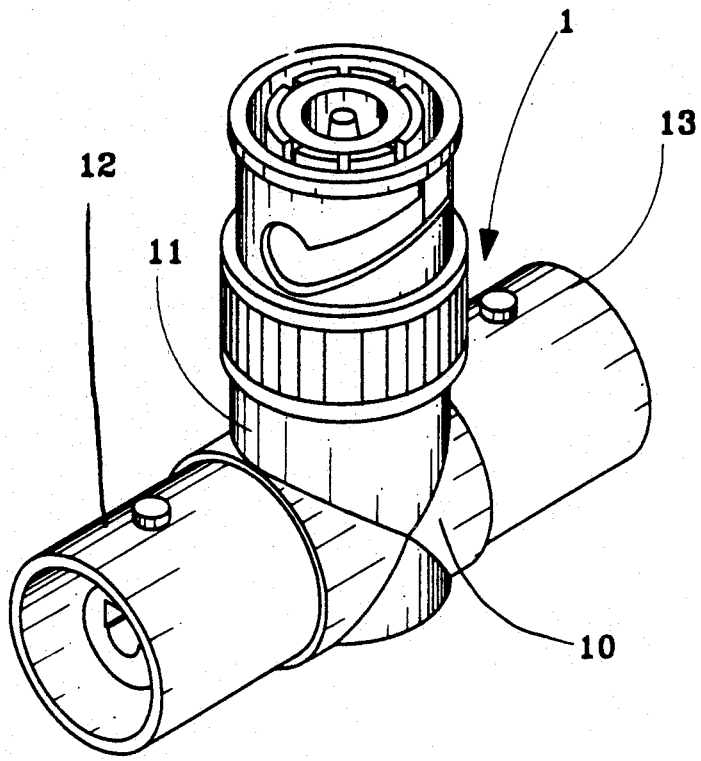
FIG. 1 is an elevational view of a T-type BNC connector embodying the present invention.

Referring to FIG. 1, the shell 10 of the T-type BNC connector 1 is consisted of a vertical coupling portion 11 and two transverse coupling portions 12,13.

Figure 2:
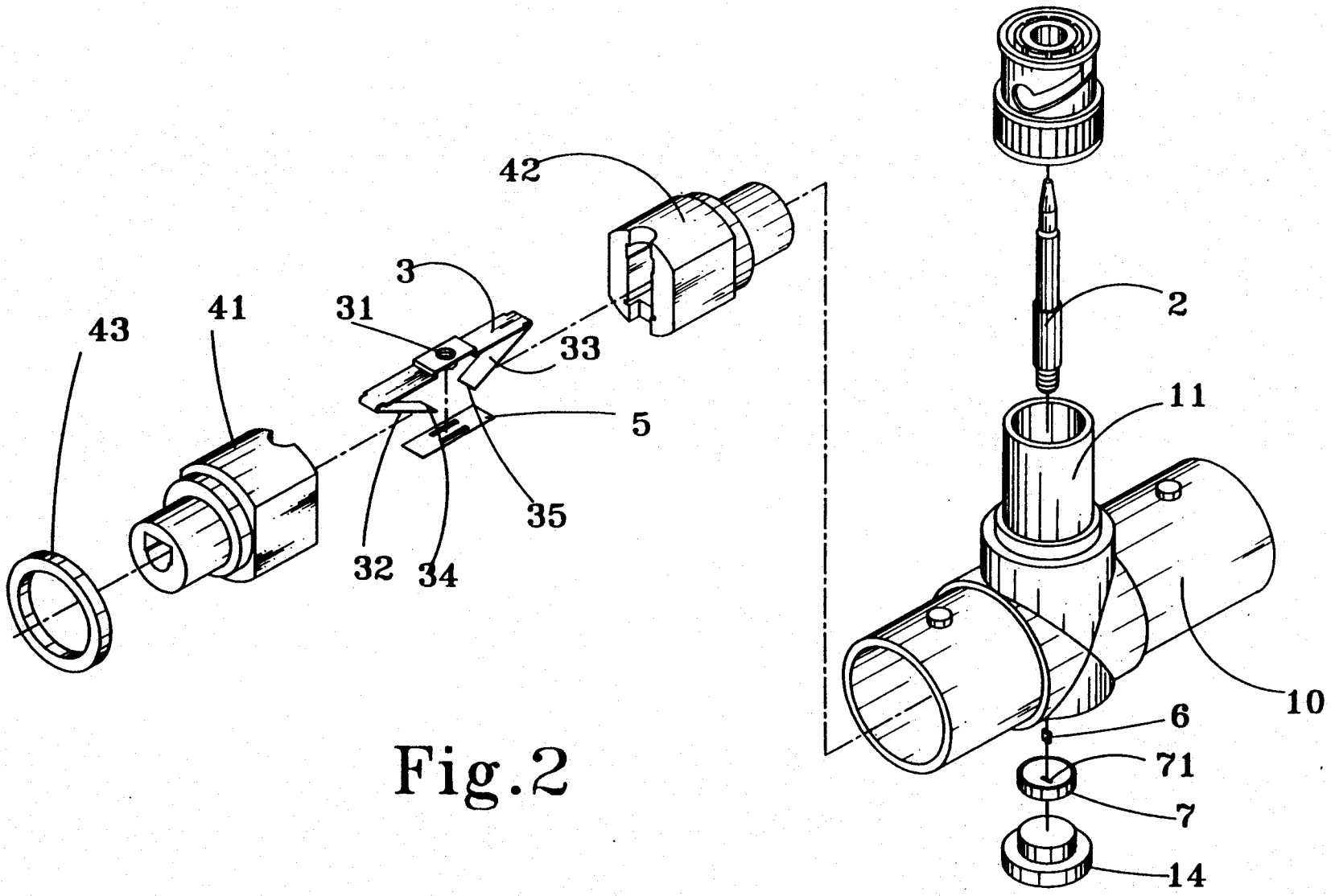
FIG. 2 is an exploded view of the T-type BNC connector shown in FIG. 1.
Figure 3:
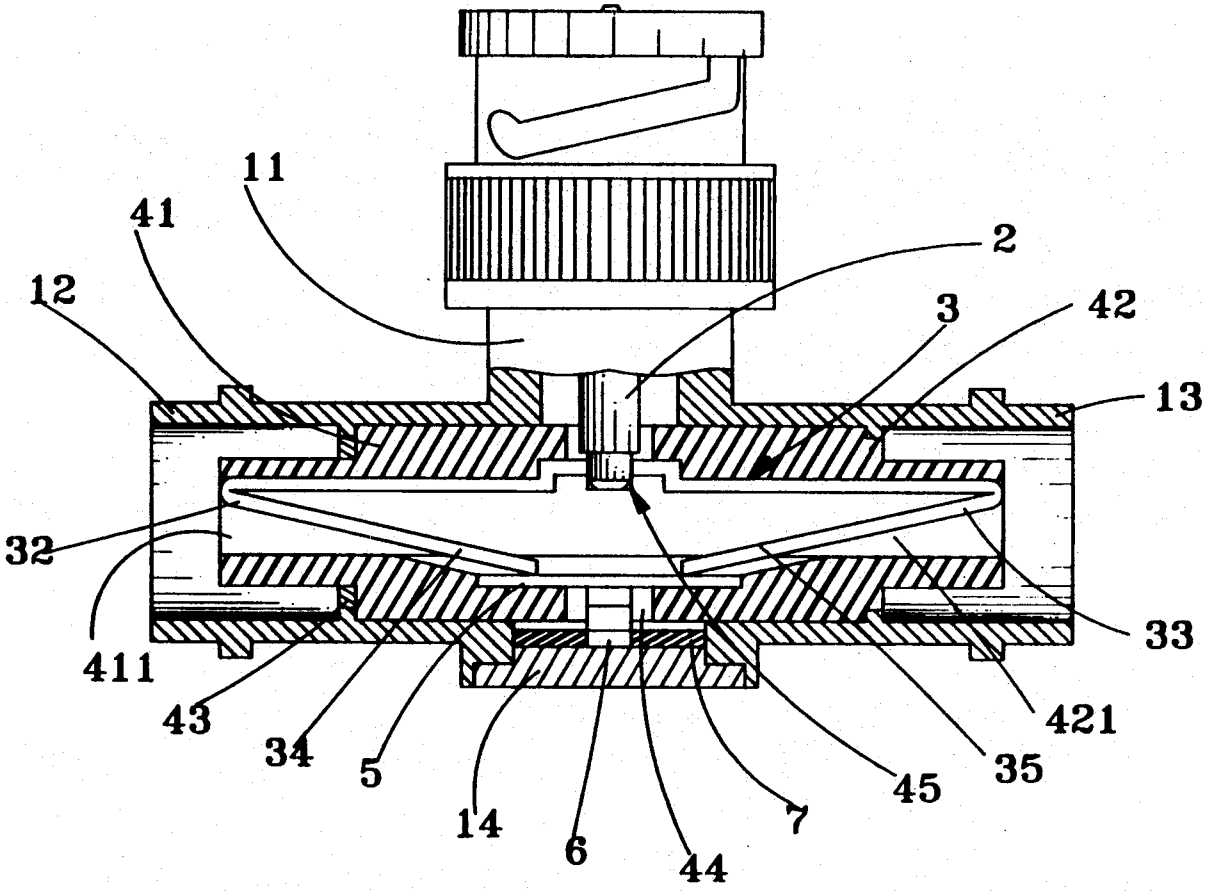
FIG. 3 is a longitudinal view in section of the T-type BNC connector shown in FIG. 1.

Referring to FIGS. 2 and 3, the vertical coupling portion 11 receives a peripherally insulated electric terminal 2. The electric terminal 2 has a top end concealed inside the vertical coupling portion 11 for connecting a BNC connector on the main cable of a computer system or the like, and a bottom end threaded into a screw hole 31 on a spring plate 3 retained inside the shell 10 by two symmetrical insulative sockets 41,42. The spring plate 3 is made from an elongated conductive plate having opposite ends bent into two inward legs 32,33, of which each is terminated into a respective contact end 34 or 35. The symmetrical insulative sockets 41,42 are respectively received inside either transverse coupling portion 12 or 13 in reverse directions and retained in line with each other by a rubber ring 43, each having a longitudinal hole 411 or 421 which receives either inward leg 32 or 33 of the spring plate 3. As the insulative sockets 41,42 are longitudinally connected, a top hole 45 and a bottom hole 44 are formed therebetween and vertically aligned with the screw hole 31 on the spring plate 3. Through the top hole 45, the electric terminal 2 is threaded into the screw hole 31 on the spring plate 3. There is a ceramic resistor 6 inserted into the bottom hole 44 and connected to a conductive plate 5. The conductive plate 5 is received inside the insulative sockets 41,42, covered over the bottom hole 44, and constantly disposed in contact with the contact ends 34,35 of the spring plate 3. Through the conductive plate 5, the ceramic resistor 6 is disposed in contact the the contact ends 34,35 of the spring plate 3. The ceramic resistor 6 has a bottom end inserted through a hole 71 on an insulator 7 and stopped against a cap 14 sealed in a bottom hole (not shown) on the shell 10.

Figure 4:
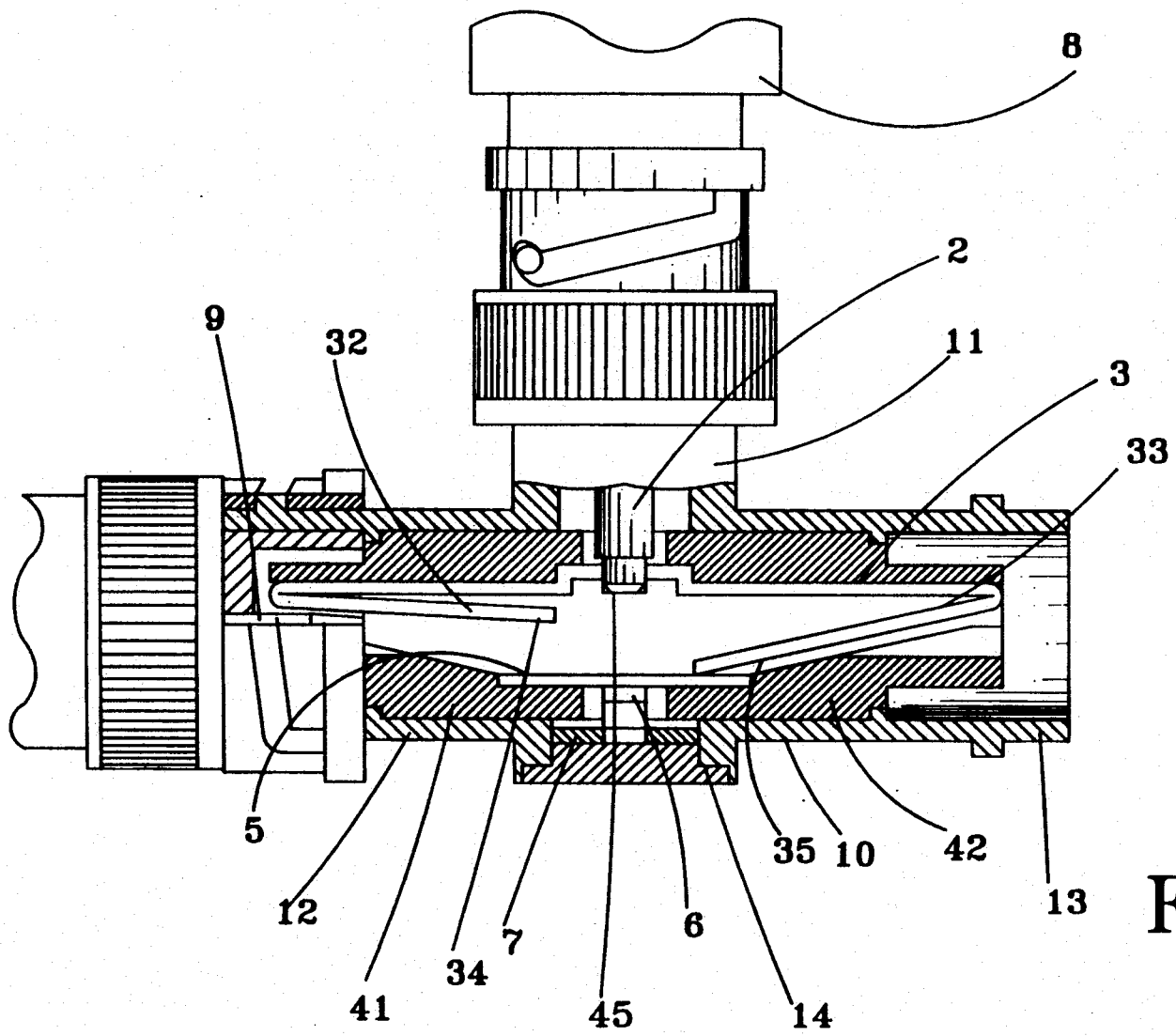
FIG. 4 is a sectional view shown a BNC connector connected to the T-type BNC connector of FIG. 1.

Referring to FIG. 4, a BNC connector 8 on the main cable of a computer system is fastened to the vertical coupling portion 11 and electrically connected to the electric terminal 2 for signal transmission, and a BNC connector of a subsidiary cable of a peripheral equipment of the computer system is fastened to one transverse coupling portion 12 while the other transverse coupling portion 13 is not in use. As illustrated, one inward leg 32 was squeezed by the electric terminal 9 of the BNC connector on the subsidiary cable in lifting its contact end 34 from the conductive plate 5, and therefore the ceramic resistor 6 becomes electrically disconnected. In this situation, any signal from the electric terminal 9 is directly transmitted through the spring plate 3 to the electric terminal 2 of the BNC connector 8 on the main cable of the computer system. Because the other transverse coupling portion 13 has no BNC connector connected thereto, the contact end 35 of the other inward leg 33 of the spring plate 3 remains in contact with the ceramic resistor 6 through the conductive plate 5, and therefore noisy signals carried through the non-operative transverse coupling portion 13 are eliminated by the ceramic resistor 6.

As indicated, the present invention uses two insulative sockets 41,42 to hold a double-contact spring plate 3 and a conductive plate 5 on the inside and a ceramic resistor 6 on the outside for eliminating the interference of outside noises. The structure is simple and therefore functional.

I claim:

1. A T-type BNC connector comprising a T-shaped shell having a vertical coupling portion and two transverse coupling portions for connecting a respective BNC connector of a computer network system, an electric terminal fastened in said vertical coupling portion, a spring plate received inside said transverse coupling portions and connected to said electric terminal, wherein said spring plate is retained inside said transverse coupling portions by two symmetrical sockets and has a screw hole, which receives a threaded bottom end of said electric terminal, and two inward contact legs respectively disposed in contact with a ceramic resistor through a flat conductor, said ceramic resistor having a top end connected to said flat conductor and a bottom end connected to said T-shaped shell.

2. The T-type BNC connector of claim 1 wherein fastening a BNC connector to either transverse coupling portion of said T-shaped shell causes the adjacent contact leg of said spring plate lifted from said flat conductor for permitting said ceramic resistor to eliminate outside noises transmitted through the other transverse coupling portion.

3. The T-type BNC connector of claim 1 wherein said ceramic resistor has a top end connected to said flat conductor and a bottom end inserted through an insulator and connected to said T-shaped shell by a cap being sealed in a bottom hole on said T-shaped shell.

* * * * *